US008007856B2

(12) United States Patent
Hossainy et al.

(10) Patent No.: US 8,007,856 B2
(45) Date of Patent: Aug. 30, 2011

(54) MOUNTING ASSEMBLY FOR A STENT AND A METHOD OF USING THE SAME TO COAT A STENT

(75) Inventors: Syed F. A. Hossainy, Fremont, CA (US); Charles Snyder, San Francisco, CA (US); Anh Tran, San Jose, CA (US); Arthur J. Wen, Sunnyvale, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 0 days.

(21) Appl. No.: 12/606,161

(22) Filed: Oct. 26, 2009

(65) Prior Publication Data

US 2010/0098834 A1 Apr. 22, 2010

Related U.S. Application Data

(62) Division of application No. 10/330,412, filed on Dec. 27, 2002, now Pat. No. 7,628,859.

(51) Int. Cl.
*B05D 1/00* (2006.01)
*B05D 1/36* (2006.01)
*B05C 13/00* (2006.01)

(52) U.S. Cl. ..... 427/2.1; 427/2.24; 427/2.25; 118/500

(58) Field of Classification Search ..... 427/2.1, 427/2.24, 2.25; 118/500
See application file for complete search history.

(56) References Cited

U.S. PATENT DOCUMENTS 4,733,665 A 3/1988 Palmaz
4,800,882 A 1/1989 Gianturco
4,886,062 A 12/1989 Wiktor
4,906,423 A 3/1990 Frisch
5,037,427 A 8/1991 Harada et al.
5,234,457 A 8/1993 Andersen
5,537,729 A 7/1996 Kolobow
5,628,786 A 5/1997 Banas et al.
5,766,192 A 6/1998 Zacca
5,772,864 A 6/1998 Møller et al.
5,788,626 A 8/1998 Thompson
5,895,407 A 4/1999 Jayaraman
5,897,911 A 4/1999 Loeffler
5,922,393 A 7/1999 Jayaraman
5,935,135 A 8/1999 Bramfitt et al.
5,980,471 A 11/1999 Jafari
6,010,573 A 1/2000 Bowlin
6,056,993 A 5/2000 Leidner et al.
6,120,847 A 9/2000 Yang et al.
6,126,686 A 10/2000 Badylak et al.
6,153,252 A 11/2000 Hossainy et al.
6,156,373 A 12/2000 Zhong et al.
6,183,503 B1 * 2/2001 Hart et al. ..... 623/1.1
6,214,115 B1 4/2001 Taylor et al.
6,258,121 B1 7/2001 Yang et al.
6,278,079 B1 8/2001 McIntyre et al.
6,322,490 B1 * 11/2001 Stack et al. ..... 600/3
6,322,847 B1 11/2001 Zhong et al.
6,364,903 B2 4/2002 Tseng et al.
6,387,118 B1 5/2002 Hanson
6,517,889 B1 * 2/2003 Jayaraman ..... 427/2.24
(Continued)

*Primary Examiner* — Timothy H Meeks
*Assistant Examiner* — Cachet I Sellman
(74) *Attorney, Agent, or Firm* — Squire, Sanders & Dempsey (US) LLP

(57) ABSTRACT

A mounting assembly for a stent and a method of coating a stent using the assembly are provided.

15 Claims, 4 Drawing Sheets

U.S. PATENT DOCUMENTS

| | | | | |
|---|---|---|---|---|
| 6,521,284 | B1 | 2/2003 | Parsons et al. | |
| 6,527,863 | B1 | 3/2003 | Pacetti et al. | |
| 6,673,154 | B1 * | 1/2004 | Pacetti et al. | 118/500 |
| 6,743,462 | B1 * | 6/2004 | Pacetti | 427/2.24 |
| 6,783,793 | B1 * | 8/2004 | Hossainy et al. | 427/2.25 |
| 6,835,059 | B2 | 12/2004 | Skinner et al. | |
| 7,175,874 | B1 * | 2/2007 | Pacetti | 427/2.25 |
| 2002/0002353 | A1 * | 1/2002 | Michal et al. | 604/265 |
| 2002/0072755 | A1 | 6/2002 | Bigus et al. | |
| 2002/0156531 | A1 | 10/2002 | Felt et al. | |
| 2003/0135255 | A1 * | 7/2003 | Sundar | 623/1.11 |
| 2003/0215564 | A1 * | 11/2003 | Heller et al. | 427/2.25 |
| 2006/0036309 | A1 | 2/2006 | Hebert et al. | |
| 2006/0177573 | A1 | 8/2006 | Pui et al. | |

* cited by examiner

375x

375x

375x

375x

MOUNTING ASSEMBLY FOR A STENT AND A METHOD OF USING THE SAME TO COAT A STENT

This application is a divisional of, and claims priority from, U.S. application Ser. No. 10/330,412 filed Dec. 27, 2002 now U.S. Pat. No. 7,628,859, the contents of which are herein incorporated by reference in its entirety for all purposes.

BACKGROUND OF THE INVENTION

1. Field of the Invention

This invention relates to a mounting system for a stent and a method of coating a stent using the device.

2. Description of the Background

Blood vessel occlusions are commonly treated by mechanically enhancing blood flow in the affected vessels, such as by employing a stent. Stents act as scaffoldings, functioning to physically hold open and, if desired, to expand the wall of the passageway. Typically, stents are capable of being compressed, so that they can be inserted through small lumens via catheters, and then expanded to a larger diameter once they are at the desired location.

FIG. 1 illustrates a conventional stent 10 formed from a plurality of struts 12. The plurality of struts 12 are radially expandable and interconnected by connecting elements 14 that are disposed between adjacent struts 12, leaving lateral openings or gaps 16 between adjacent struts 12. Struts 12 and connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that can produce adverse or even toxic side effects for the patient.

One method of medicating a stent involves the use of a polymeric carrier coated onto the surface of the stent. A composition including a solvent, a polymer dissolved in the solvent, and a therapeutic substance dispersed in the blend is applied to the stent by immersing the stent in the composition or by spraying the composition onto the stent. The solvent is allowed to evaporate, leaving on the stent surfaces a coating of the polymer and the therapeutic substance impregnated in the polymer.

A shortcoming of the above-described method of medicating a stent is the potential for coating defects. While some coating defects can be minimized by adjusting the coating parameters, other defects occur due to the nature of the interface between the stent and the apparatus on which the stent is supported during the coating process. A high degree of surface contact between the stent and the supporting apparatus can provide regions in which the liquid composition can flow, wick, and collect as the composition is applied. Upon the removal of the coated stent from the supporting apparatus, the excess coating may stick to the apparatus, thereby removing some of the coating from the stent in the form of peels as shown in FIG. 2, or leaving bare areas as shown in FIG. 3. Alternatively, as illustrated in FIG. 4, the excess coating may stick to the stent, thereby leaving excess coating as clumps or pools on the struts or webbing between the struts. These types of defects can cause adverse biological responses after the coated stent is implanted into a biological lumen. For instance, the tissue surrounding the biological lumen adjacent to the ends of stent 10 can adversely react to the coating defects (known as the "edge effect.")

Accordingly, the present invention provides an apparatus for coating a stent that does not suffer from the aforementioned shortcomings. The invention also provides for a method of coating the stent using the apparatus.

SUMMARY OF THE INVENTION

In accordance with one aspect of the present invention, a mounting assembly for supporting a stent during the application of a coating composition is disclosed, comprising a mandrel, a stem extending from the mandrel for insertion into a hollow bore of a stent, the diameter of the stem being smaller than the inner diameter of the stent, and a bulbous protrusion extending out from the stem for supporting the stent during the application of a coating substance to the stent. In one embodiment, the length of the stem plus the bulbous protrusion is equal to or less than about one half of the length of the stent. In another embodiment, the bulbous protrusion is capable of inflating from a collapsed configuration to an expanded configuration and deflating from the expanded configuration to the collapsed configuration or a deflated profile. In yet another embodiment, the mounting assembly additionally comprises a barrier positioned between a spray applicator and the stent.

According to another aspect, a mounting assembly for supporting a stent is disclosed, comprising a pair of arms capable of being inserted into a hollow bore of a stent such that an outward biasing of the arms forces each arm to engage with an inner surface of the stent for supporting the stent in a secure position. In one embodiment, the arms are configured to self-bias in an outwardly direction to engage with the inner surface of the stent.

According to yet another aspect of the present invention, a method of coating a stent is disclosed, comprising inserting one end of a stent over a stem having a bulbous protrusion, wherein the stent is supported by the bulbous protrusion, and spraying a coating composition on the stent. In one embodiment, the bulbous protrusion is capable of inflating from a collapsed configuration to an expanded configuration and deflating from the expanded configuration to the collapsed configuration or a deflated profile, and wherein the method additionally comprises deflating the bulbous protrusion for insertion of the one end of the stent over the stem and inflating the bulbous protrusion to securely position the stent on the stem. In another embodiment, the method additionally includes masking the region of the stent where the bulbous protrusion is in contact with the stent.

According to a further aspect, a method of coating a stent is disclosed, comprising inserting a pair of arms inside the hollow bore of a stent, causing the arms to expand outwardly to engage with an inner surface of the stent to securely support the stent, and applying a coating composition to the stent.

According to yet another aspect, a method of coating a stent is disclosed, comprising securing a stent on a first mandrel, applying a first coating substance to the stent, transferring the stent to a second mandrel, and applying a second coating substance to the stent. In one embodiment, the act of securing the stent on the first mandrel comprises inserting one end of the stent over a mandrel wherein the first mandrel can apply a pressure to an inside surface of the stent to securely hold the stent. In another embodiment, the method additionally includes masking a segment of the stent that is in contact with the first mandrel during the application of the first coating substance to the stent and masking a segment of the stent that is in contact with the second mandrel during the application of the second coating substance to the stent.

DETAILED DESCRIPTION

Figure 1:
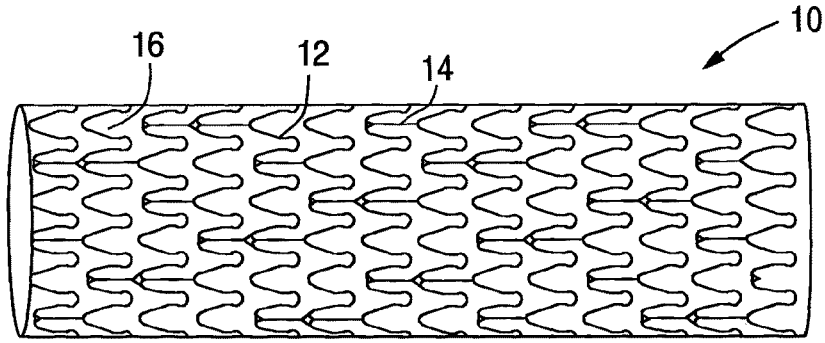
FIGURE 1 (PRIOR ART)
FIG. 1 illustrates a conventional stent.
Figure 6:
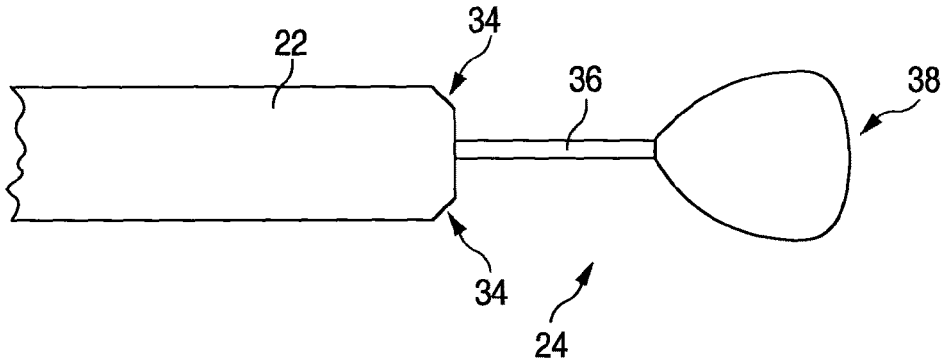
FIG. 6 is a side view of a mounting member for supporting a stent in accordance with one embodiment of the present invention.
Figure 5:
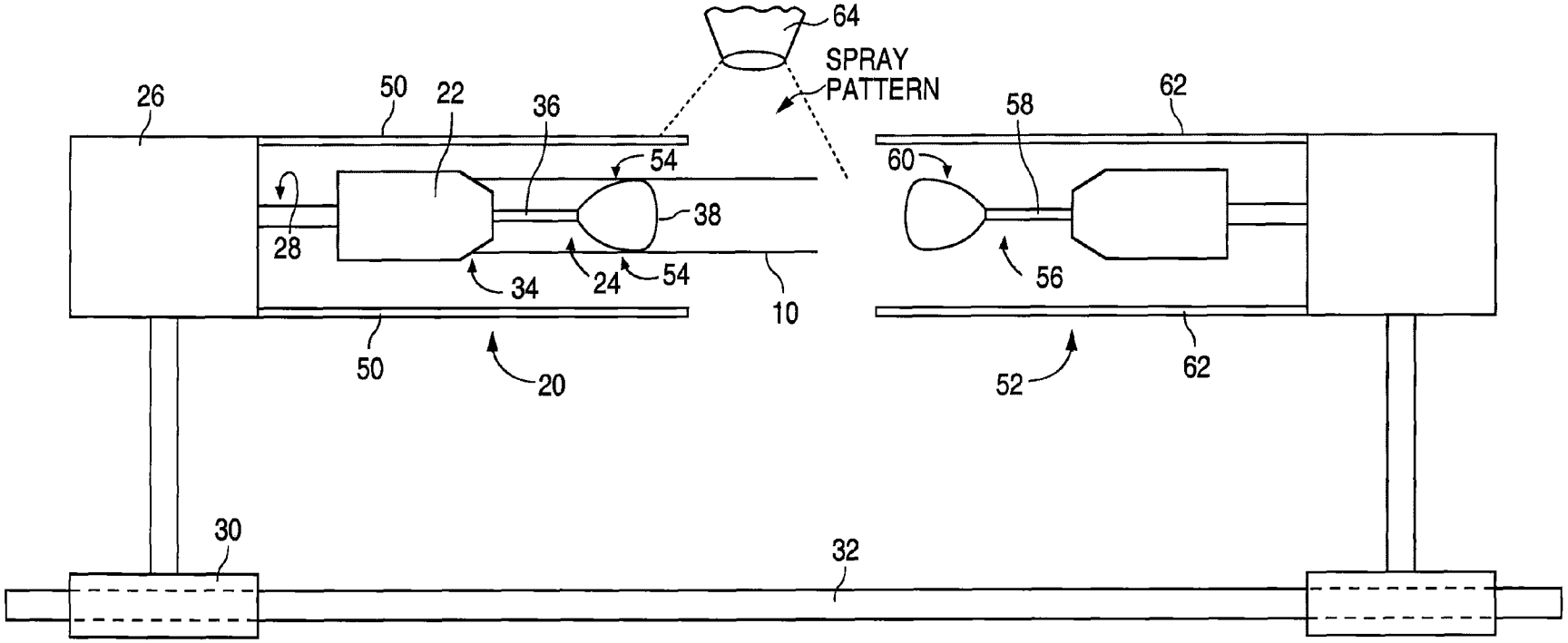
FIG. 5 illustrates a coating system including a mounting assembly for supporting a stent in accordance with one embodiment of the present invention.

The type of stent used with the present invention is not of critical significance and the term "stent" is broadly intended to include stent-grafts or radially expandable stents, such as balloon-expandable stents or the self-expandable type. Referring to FIG. 5, a mounting assembly 20 for supporting stent 10 during a coating process is illustrated to include a mandrel 22 and a plug 24. Mandrel 22 can be connected to a motor 26 that provides rotational motion as depicted by arrow 28 about the longitudinal axis of stent 10 during the coating process. A second motor 30 can also be provided for moving mounting assembly 20 in a linear direction, back and forth, along a rail 32. In one embodiment, as best illustrated in FIGS. 5 and 6, mandrel 22 is illustrated to have a coning end portion 34 that is configured to be inserted at least partially into one end of stent 10. Accordingly, in this embodiment, the outer end ring(s) or edge of stent 10 can rest on the coning end portion 34 of mandrel 22.

Plug 24 includes a stem 36 extending from mandrel 22 and a bulbous protrusion 38 connected to and extending out from stem 36. The diameter of stem 36 is considerably smaller than the inner diameter of stent 10 as mounted on mounting assembly 20. Bulbous protrusion 38 provides further support for stent 10 during the application of a coating composition to the stent. Plug 24 can include multiple protruding portions for adequate support of stent 10. For example, plug 24 can be dumbbell shaped with a stem and two bulbous protrusions extending out from the stem. In one embodiment, the length of plug 24 should be less than half of the length of the stent employed. By way of example, the length of plug 24 can be about 0.080 inches (2.03 mm) to about 0.590 inches (14.99 mm) for a stent having a length of 0.315 inches (8.0 mm) to about 1.50 inches (38.1 mm). The bulbous protrusions can be spherical, having an almost equivalent diameter to the inner diameter of stent 10 as positioned on mounting assembly 20 so as to allow a friction fit between the bulbous protrusion and stent 10. By way of example, the outer diameter of the bulbous protrusion can be from about 0.040 inches (1.02 mm) to about 0.540 inches (13.72 mm) for a stent-mounting diameter of about 0.059 inches (1.50 mm) to about 0.550 inches (13.97 mm). Representative examples of other shapes that the protrusions may have include rectangular-, star-, triangular-, or octagonal-shaped.

Bulbous protrusion 38 can be made of materials that are firm or semi-pliable. The material should have a low friction coefficient and should be resistant to solvents and heat, which may be directed onto the apparatus during the coating process. Representative examples of materials that can be used for bulbous protrusion 38 include stainless steel, polyetheretherketone (PEEK), polytetrafluoroethylene (PTFE) (Teflon™), Delrin™, Rulon™, Pebax™, fluorinated ethylene-propylene copolymer (FEP), or any suitable nylon.

In another embodiment, bulbous protrusion 38 can be inflatable via a liquid or gas. In other words, a balloon or bladder can be attached to a hollow stem to allow bulbous protrusion 38 to dilate from a collapsed configuration to an expanded configuration and to deflate from the expanded configuration to a deflated profile. Stem 36, which would be in essence a hollow tube, would be in fluid communication with a liquid or gas source to control the dilation of the bulbous protrusion. With the use of an inflatable plug, as compared to a solid structure, a firmer engagement between stent 10 and mounting assembly 20 can be established. Moreover, the mounting and dismounting of stent 10 from the assembly can be conducted more easily. The balloon or bladder can be made of a non-compliant material, such as nylon or PET or a substantially non-compliant material, such as polyethylene. Alternatively, the balloon or bladder can be made of a compliant material such as latex or polyurethane.

Figure 7:
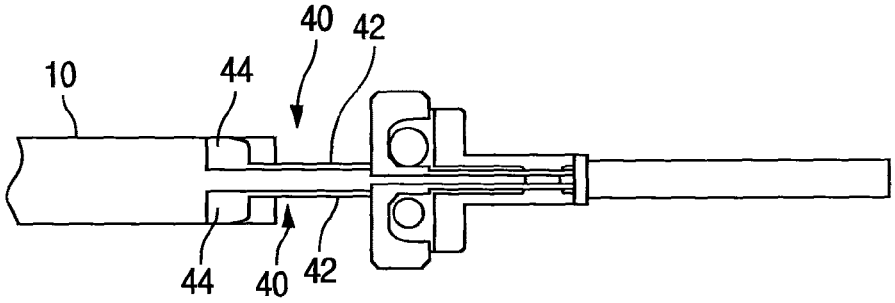
FIG. 7 is a side view of a mounting member in accordance with one embodiment of the present invention.
Figure 2:
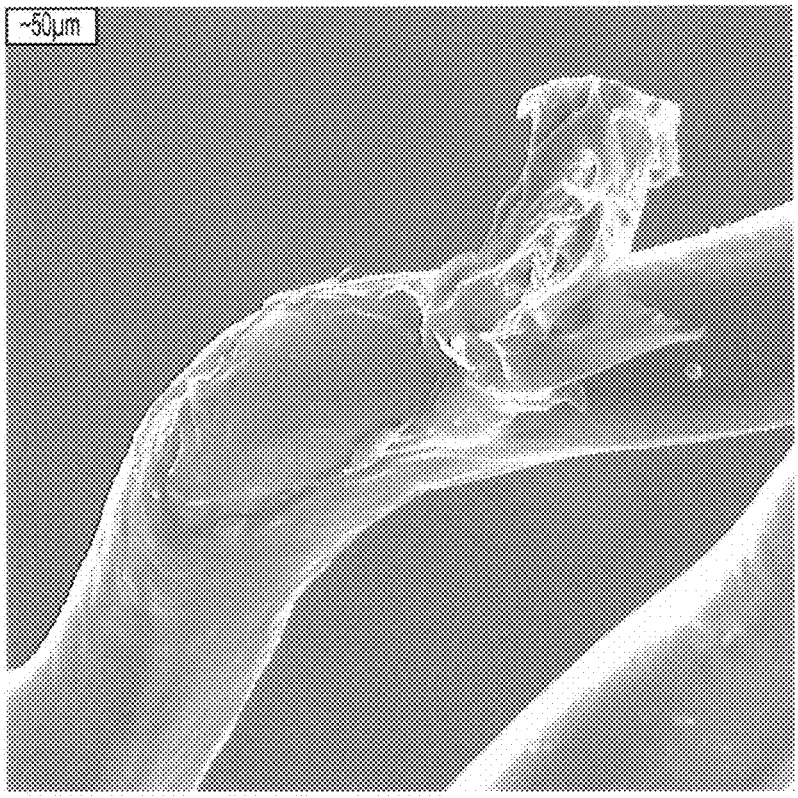
FIGS. 2-4 are scanning electron microscope images of stent coatings with coating defects.
Figure 3:
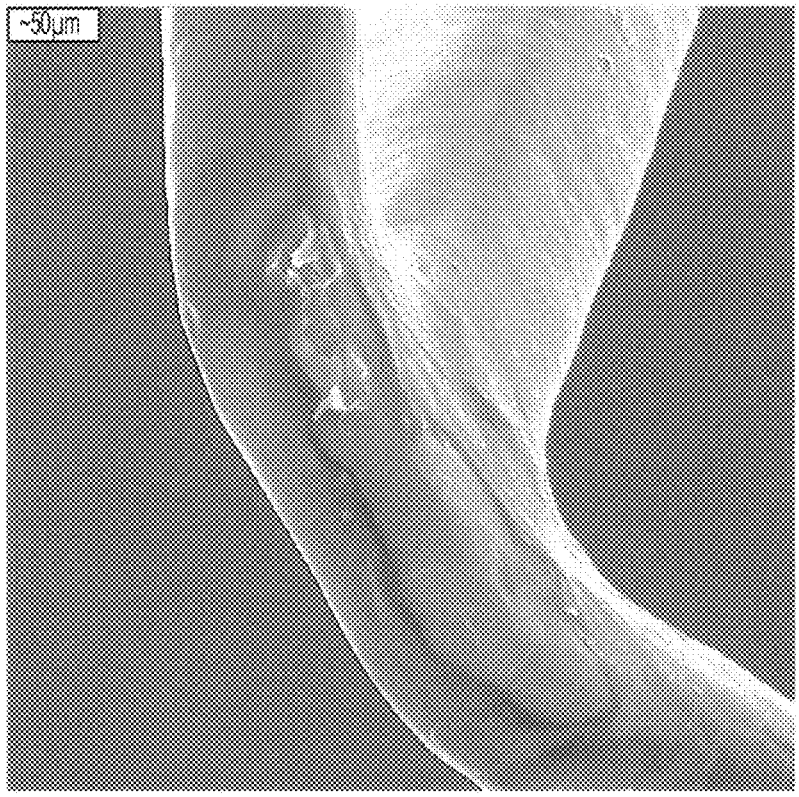
Figure 4:
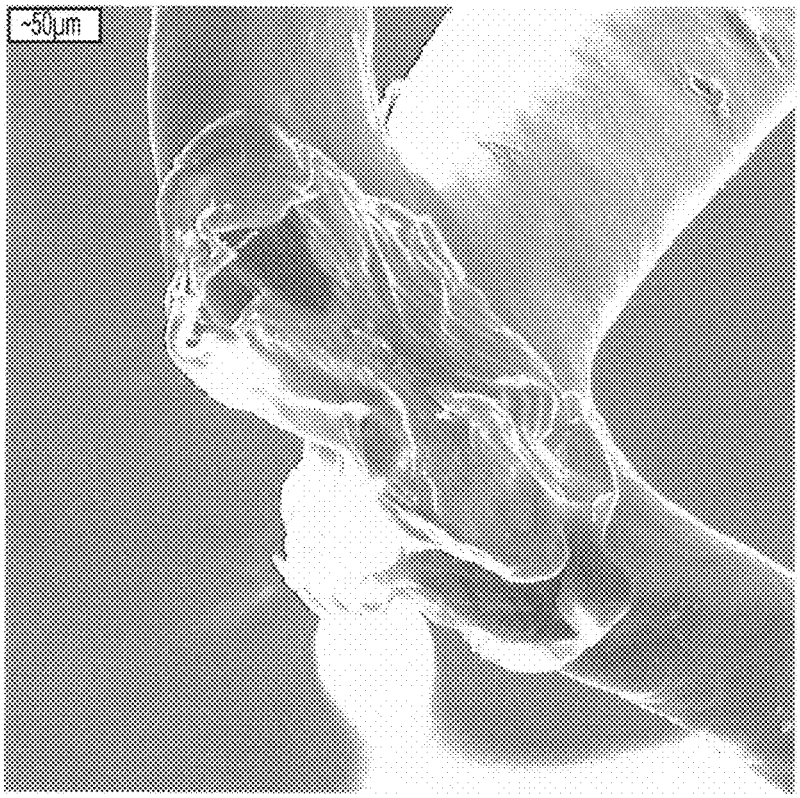

In accordance with another embodiment, referring to FIG. 7, the mounting assembly can include a clasping device instead of a plug. The clasping device can have self-expandable spring clips 40 that physically engage stent 10 by expanding outwardly to compress against the inner surface of stent 10. Clips 40 include biasing arm elements 42 and a base 44 attached to the end of arm elements 42. At least a pair of arm elements 42 should suffice to securely hold stent 10. Arm elements 42 can be forced or pinched together inwardly and inserted into one end of stent 10. The removal of the force allows arm elements 42 to self-bias outwardly to allow bases 44 to securely engage with the inner surface of stent 10. The biasing force of clips 40 should be strong enough to securely hold stent 10 during the coating process. Alternatively, arm elements 42 can be manually biased outwardly by application of an outward force to the clips 40.

In another embodiment of the present invention, the mounting assembly is in communication with a piezoelectric transducer. The high frequency or ultra high frequency (ultrasonic) sound waves supplied by the transducer can be directed to the mounting assembly to modify the position of the contact area during the spray coating process. For example, the transducer can be directed to the surface of bulbous protrusion 38 of plug 24. The sounds waves can be of sufficient intensity so that the surface of bulbous protrusion 38 experiences vibrations.

Referring back to FIG. 5, a mask 50 can be attached to first motor 26 or otherwise positioned, such as on mandrel 22, to cover a portion of stent 10. The portion of stent 10 covered by mask 50 should extend at least partially beyond the contact area formed between the bulbous protrusion or clips and the inner surface of stent 10. Mask 50 can be a plate or tubular-shaped cap that surrounds the entire perimeter of stent 10. Mask 10, for example, can be removably or adjustably attached to motor 26 or mandrel 22. Representative examples of materials that can be used for mask 50 for this embodiment include stainless steel and polytetrafluoroethylene (PTFE) (Teflon™). In another embodiment, the mask can be is a bisected tube with a hinge.

In yet another embodiment, the mask can be applied directly onto the surface of stent 10 in the form of a removable film. The film can be used in conjunction with a structural mask as described above. The removable film is firmly attached to the surface of stent 10 so that the film remains on the surface as stent 10 is moved (e.g., rotated) during the coating process. The film should not leave any material residue on the surface of stent 10 after the film is removed from the surface. A representative example of a film that can be used for the mask for this embodiment is plastic tape.

In one embodiment, once the portion of stent 10 not covered by mask 50 has been coated, stent 10 can be removed, flipped around, and the other end of stent 10 can be positioned on mounting assembly 20. Alternatively, as illustrated in FIG. 5, the system of the present invention can also include a second mounting assembly 52 having the same components as the mounting assembly described above. Accordingly stent 10 can be transferred from one mounting assembly to the other for deposition of a coating substance to the entire outer surface of the stent. With the use of inflatable bulbous protrusions or clips, this process can be fully automated without any handling or touching of stent by an operator.

Referring to FIG. 5, while the composition is applied to stent 10, stent 10 can be rotated about the stent's central longitudinal axis. Rotation of the stent can be from about 1 rpm to about 300 rpm, more narrowly from about 50 rpm to about 150 rpm. By way of example, the stent can rotate at about 120 rpm. Mask 50 can be used to cover contact area 54 thereby substantially reducing the amount of composition applied to the surface of stent 10 at and adjacent to contact area 54. In addition to rotational movement, mounting assembly 20 can be moved in a linear direction along the longitudinal axis of stent 10. The stent can be moved at about 1 mm/second to about 12 mm/second, for example about 6 mm/second, or for a minimum of at least two passes (i.e., back and forth past the spray nozzle).

After the composition has been applied to a first half of the stent, the composition can be dried to form a coating. The stent can be either flipped around or second mounting assembly 52 can be used to coat the other half of stent. For example stent 10 can be moved along rail 32 so that a plug 56 of second mounting assembly 52 can be inserted into the other end of stent 10. Once second plug 56 is firmly engaged with the interior of stent 10, first plug 24 is removed from the hollow bore of stent 10. The composition can then be applied to the other half of stent 10 while a second mask 62 covers the coated segment of stent 10. Coating uniformity can be achieved when stent 10 is transferred between the plugs by spraying an equal amount of coating on both halves of stent 10. To minimize an overlap or gap between the halves, the positioning of the masks can be adjusted to ensure that the masks are not over or under extended. Additionally, it can be useful to automate the transfer of stent 10 between the plugs 24 and 56 to minimize stent handling during the stent coating process.

With the use of inflatable bulbous protrusions, once a first half of stent 10 is coated, stent 10 is inserted over a deflated bulbous protrusion of the second mounting assembly. The bulbous protrusion of the second mounting assembly is then inflated followed by deflation of the bulbous protrusion of the first mounting assembly. The first mounting assembly is then moved away from the second mounting assembly along the rail to allow spray nozzle 64 to coat the remaining half of stent 10. A similar methodology can be used with clasping devices.

The following method of application is being provided by way of illustration and is not intended to limit the embodiments of the present invention. A spray apparatus, such as EFD 780S spray device with VALVEMATE 7040 control system (manufactured by EFD Inc., East Providence, R.I.), can be used to apply a composition to a stent. EFD 780S spray device is an air-assisted external mixing atomizer. The composition is atomized into small droplets by air and uniformly applied to the stent surfaces. The atomization pressure can be maintained at a range of about 5 psi to about 20 psi. The droplet size depends on such factors as viscosity of the solution, surface tension of the solvent, and atomization pressure. Other types of spray applicators, including air-assisted internal mixing atomizers and ultrasonic applicators, can also be used for the application of the composition.

The flow rate of the solution from the spray nozzle can be from about 0.01 mg/second to about 1.0 mg/second, more narrowly about 0.1 mg/second. Multiple repetitions for applying the composition can be performed, wherein each repetition can be, for example, about 1 second to about 10 seconds in duration. The amount of coating applied by each repetition can be about 0.1 micrograms/$cm^2$ (of stent surface) to about 10 micrograms/$cm^2$, for example less than about 2 micrograms/$cm^2$ per 5-second spray.

Each repetition can be followed by removal of a significant amount of the solvent(s). Depending on the volatility of the particular solvent employed, the solvent can evaporate essentially upon contact with the stent. Alternatively, removal of the solvent can be induced by baking the stent in an oven at a mild temperature (e.g., 60° C.) for a suitable duration of time (e.g., 2-4 hours) or by the application of warm air. The application of warm air between each repetition prevents coating defects and minimizes interaction between the active agent and the solvent. The temperature of the warm air can be from about 30° C. to about 60° C., more narrowly from about 40° C. to about 50° C. The flow rate of the warm air can be from about 20 cubic feet/minute (CFM) (0.57 cubic meters/minute (CMM)) to about 80 CFM (2.27 CMM), more narrowly about 30 CFM (0.85 CMM) to about 40 CFM (1.13 CMM). The warm air can be applied for about 3 seconds to about 60 seconds, more narrowly for about 10 seconds to about 20 seconds. By way of example, warm air applications can be performed at a temperature of about 50° C., at a flow rate of about 40 CFM, and for about 10 seconds. Any suitable number of repetitions of applying the composition followed by removing the solvent(s) can be performed to form a coating of a desired thickness or weight. Excessive application of the polymer in a single application can, however, cause coating defects.

Operations such as wiping, centrifugation, or other web clearing acts can also be performed to achieve a more uniform coating. Briefly, wiping refers to the physical removal of excess coating from the surface of the stent; and centrifugation refers to rapid rotation of the stent about an axis of rotation. The excess coating can also be vacuumed off of the surface of the stent.

The stent can be at least partially preexpanded prior to the application of the composition. For example, the stent can be radially expanded about 20% to about 60%, more narrowly about 27% to about 55%—the measurement being taken from the stent's inner diameter at an expanded position as compared to the inner diameter at the unexpanded position. The expansion of the stent, for increasing the interspace between the stent struts during the application of the composition, can further prevent "cob web" formation between the stent struts.

The composition can include a solvent and a polymer dissolved in the solvent. The composition can also include active agents. Representative examples of polymers that can be used to coat a medical device in accordance with the present invention include ethylene vinyl alcohol copolymer (commonly known by the generic name EVOH or by the trade name EVAL), poly(hydroxyvalerate); poly(L-lactic acid); polycaprolactone; poly(lactide-co-glycolide); poly(hydroxybutyrate); poly(hydroxybutyrate-co-valerate); polydioxanone; polyorthoester; polyanhydride; poly(glycolic acid); poly(D, L-lactic acid); poly(glycolic acid-co-trimethylene carbonate); polyphosphoester; polyphosphoester urethane; poly (amino acids); cyanoacrylates; poly(trimethylene carbonate); poly(iminocarbonate); copoly(ether-esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose; cellulose acetate; cellulose butyrate; cellulose acetate butyrate; cellophane; cellulose nitrate; cellulose propionate; cellulose ethers; and carboxymethyl cellulose.

"Solvent" is defined as a liquid substance or composition that is compatible with the polymer and is capable of dissolving the polymer at the concentration desired in the composition. Examples of solvents include, but are not limited to, dimethylsulfoxide (DMSO), chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methyl pyrrolidinone, toluene, and combinations thereof.

The active agent can be for inhibiting the activity of vascular smooth muscle cells. More specifically, the active agent can be aimed at inhibiting abnormal or inappropriate migration and/or proliferation of smooth muscle cells for the inhibition of restenosis. The active agent can also include any substance capable of exerting a therapeutic or prophylactic effect in the practice of the present invention. For example, the agent can be for enhancing wound healing in a vascular site or improving the structural and elastic properties of the vascular site. Examples of agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_I$. The active agent can also fall under the genus of antineoplastic, anti-inflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. Taxotere®, from Aventis S.A., Frankfurt, Germany), methotrexate, azathioprine, vincristine, vinblastine, fluorouracil, doxorubicin hydrochloride (e.g. Adriamycin® from Pharmacia & Upjohn, Peapack N.J.), and mitomycin (e.g. Mutamycin® from Bristol-Myers Squibb Co., Stamford, Conn.) Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as Angiomax ä (Biogen, Inc., Cambridge, Mass.) Examples of such cytostatic or antiproliferative agents include angiopeptin, angiotensin converting enzyme inhibitors such as captopril (e.g. Capoten® and Capozide® from Bristol-Myers Squibb Co., Stamford, Conn.), cilazapril or lisinopril (e.g. Prinivil® and Prinzide® from Merck & Co., Inc., Whitehouse Station, N.J.), calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name Mevacor® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is pemirolast potassium. Other therapeutic substances or agents which may be appropriate include alpha-interferon, genetically engineered epithelial cells, dexamethasone and rapamycin and structural derivatives or functional analogs thereof, such as 40-O-(2-hydroxy)ethyl-rapamycin (known by the trade name of EVEROLIMUS available from Novartis), 40-O-(3-hydroxy) propyl-rapamycin, 40-O-[2-(2-hydroxy)ethoxy]ethyl-rapamycin, and 40-O-tetrazole-rapamycin.

Example

Stents provided by Guidant Corporation were used for this example. Three layers of polymer solution were applied to the stents: a primer layer, a drug layer and a top coat layer. Two different polymer solutions for the layers were prepared. A 2% EVAL solution in N,N-dimethylacetamide (DMAC) was prepared for the primer and top coat layers. A solution having 0.67% Actinomycin-D (wt/wt), 2% EVAL (wt/wt), and 97.33% DMAC (wt/wt) was prepared for the drug layer of the coating.

For each of the three layers, the stents were mounted on a plug insert along the first segment of the stents. A contact area was formed between the plug and the inner surface of the stents which were covered by a mask. The stents were then sprayed with the polymer solution along the second segment of the stents with multiple spray cycles. The stents were then heated in an oven to essentially remove the DMAC solvent from the respective layer to form coatings on the second segment of the stents. For the primer layer, the coatings were heated for about 1 hour at about 140° C. For the drug and top coat layers, the coatings were heated for about 2 hours at about 50° C.

The process was repeated in order to apply the composition to the first segment of the stent. After the final drying, a coating was formed along the entire length of the stent. For each layer, both segments of the stents were coated and dried before proceeding to the application of the subsequent layer. For instance, the primer layer was applied to both segments before the drug layer was applied.

Figure 8:
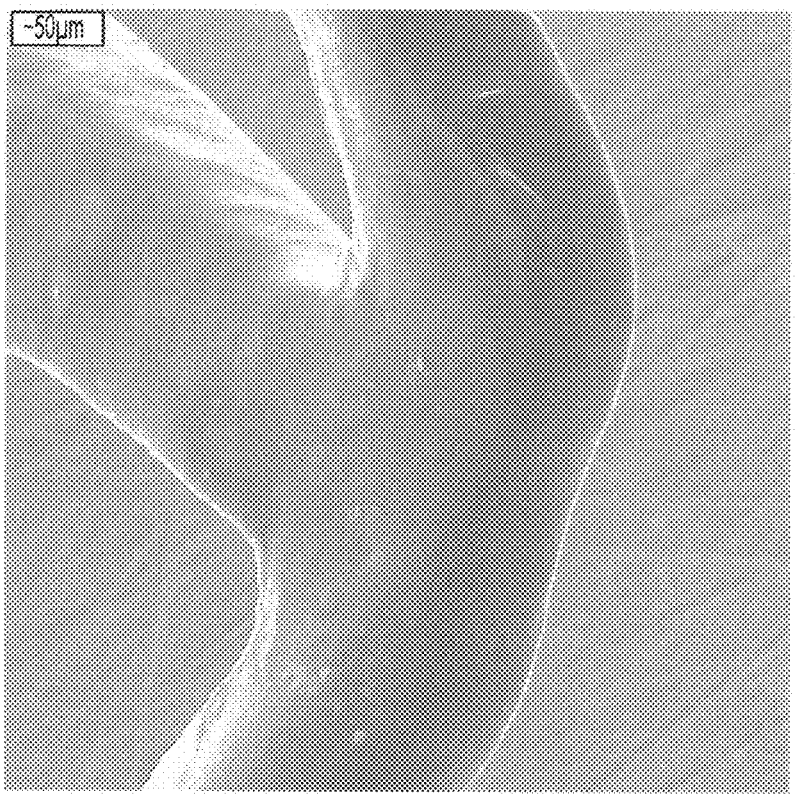
FIG. 8 is a scanning electron microscope image of a stent coating in accordance with Example 1.

The coatings were then studied using a Scanning Electron Microscope (SEM) to determine if there were visible coating defects as a result of the coating process. As illustrated in FIG. 8, there were substantially no visible coating defects.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. A method for coating a stent, comprising:
securing a first end of a stent on a first mandrel;
applying a first coating substance to the stent;
transferring the stent to a second mandrel; and
applying a second coating substance to the stent;
wherein the transferring the stent to the second mandrel includes the steps of
inserting the second mandrel in a second end of the stent;
after the inserting the second mandrel step, the second mandrel applying a pressure to an inside surface of the stent to securely hold the stent from the second end;
releasing a pressure applied to the stent by the first mandrel; and
after releasing the pressure, removing the first mandrel from the first end of the stent.

2. The method of claim 1, wherein the applying a pressure to an inside surface of the stent includes one of inflating a bulbous portion and extending arms of the second mandrel so as to engage the bulbous portion and arms, respectively, with the inside surface of the stent.

3. The method of claim 1, wherein the applying a first coating substance to the stent is applying a composition to a first portion of the stent, and wherein the applying a second coating substance to the stent is applying the same composition to a second portion of the stent, after the composition was applied to the first portion.

4. A method for coating a stent, comprising:
securing the stent on a first mandrel;
applying a first coating substance to the stent;
transferring the stent to a second mandrel; and
applying a second coating substance to the stent;
additionally including masking a stent portion with a mask, wherein the stent portion is masked during the application of the first coating substance, and removing the mask from the stent portion prior to the application of the second coating substance.

5. A method for coating a stent, comprising:
securing the stent on a first mandrel;
applying a first coating substance to the stent;
transferring the stent to a second mandrel; and
applying a second coating substance to the stent;
further including the step of masking a portion of the stent before applying the first coating substance.

6. The method of claim 5, wherein the applying a first coating substance to the stent is applying a composition to a first portion of the stent, and wherein the applying a second coating substance to the stent is applying the same composition to a second portion of the stent, after the composition is applied to the first portion.

7. A method for coating a stent, comprising:
securing a first end of the stent on a first mandrel;
applying a first coating substance to the stent;
transferring the stent to a second mandrel;
removing the first end of the stent from the first mandrel; and
after removing the first end, applying a second coating substance to the stent.

8. A method for coating a stent having a first end and a second end, comprising:
supporting the stent from the first end using a first mandrel, the first end comprising a first portion, the second end being unsupported;
masking the first portion;
applying a coating substance to a second portion of the stent;
supporting the stent from the second end using a second mandrel, the second end comprising the second portion, and removing the first end from the first mandrel so that the first end is unsupported; and
applying a coating substance to the first portion of the stent.

9. The method of claim 8, wherein the first mandrel includes a mask and the supporting the stent from the first end using the first mandrel includes masking the first portion with the mask.

10. The method of claim 8, wherein the coating substance applied to the first and second portions is the same coating substance.

11. A method for coating a stent having a first end and a second end, comprising:
providing a mandrel assembly, the mandrel assembly having a first support and a second support;
engaging the stent first end with the first support;
applying a coating substance to the second end;
moving the stent towards the second support by moving one of the first support and the second support towards the other of the first support and the second support;
engaging the second support;
disengaging the first support; and
applying a coating substance to the second end.

12. The method of claim 11, wherein the engaging the stent with the first support includes disposing the first end within a mask.

13. The method of claim 11, wherein the engaging the stent with the second support includes inflating a bulbous portion of the second support so as to engage an inside surface of the stent.

14. The method of claim 11, wherein the moving the stent towards the second support includes sliding the first support and/or second support along a rail.

15. The method of claim 11, wherein the same coating substance is applied to the first and second ends.

* * * * *